US008276576B1

(12) United States Patent
Kuhn

(10) Patent No.: US 8,276,576 B1
(45) Date of Patent: Oct. 2, 2012

(54) BOWSTRING VIBRATION AND NOISE ELIMINATOR

(76) Inventor: Todd Kuhn, North East, MD (US)

( * ) Notice: Subject to any disclaimer, the term of this patent is extended or adjusted under 35 U.S.C. 154(b) by 303 days.

(21) Appl. No.: 12/800,874

(22) Filed: May 25, 2010

(51) Int. Cl.
*F41B 5/20* (2006.01)

(52) U.S. Cl. ..... 124/89; 124/25

(58) Field of Classification Search ..... 124/23.1, 124/25.6, 86, 88, 89, 25, 92
See application file for complete search history.

(56) References Cited

U.S. PATENT DOCUMENTS 5,452,704 A * 9/1995 Winebarger ..... 124/92
5,720,269 A * 2/1998 Saunders ..... 124/86
6,237,584 B1 5/2001 Sims
6,761,158 B2 7/2004 Wright
7,753,044 B2 * 7/2010 Goade ..... 124/89
7,793,646 B2 * 9/2010 Cooper et al. ..... 124/89
8,011,356 B2 * 9/2011 Gordon et al. ..... 124/88

* cited by examiner

*Primary Examiner* — John Ricci
(74) *Attorney, Agent, or Firm* — Brian S. Steinberger; Law Offices of Brian S. Steinberger, P.A.

(57) ABSTRACT

The invention is a system that prevents the transfer of vibration from a bowstring to a bow riser and simultaneously silences the bowstring from making audible noise. The invention mounts to the riser of a bow or crossbow and disposes at.least one rigid finger and integral brush combination adjacent to the bowstring when the bowstring is in the neutral at-rest position. Upon release, the bowstring travels along a path parallel to the rigid finger and through the brush bristles. Kinetic energy of the bowstring is transferred to the brush bristles without inducing any vibration in the bow riser, and the bowstring quickly returns to the at-rest position without audible vibration.

12 Claims, 7 Drawing Sheets

BOWSTRING VIBRATION AND NOISE ELIMINATOR

BACKGROUND OF THE INVENTION

1. Field of the Invention

The present invention relates to the field of archery. Specifically, the invention relates to devices used to diminish undesirable bowstring vibration and noise following projectile release.

2. Description of the Prior Art

It is well established in the field of archery that the act of drawing and releasing a bowstring causes the bowstring to oscillate before finally coming to rest at a neutral position. This high frequency oscillation results in an audible "twang" and translates much of the vibrational energy to the bow. Often such an audible twang may be loud enough to spook a target animal. The spooked animal may move suddenly, thereby causing the already released arrow to strike a less desirable portion of the target or not at all. Vibrational energy translated to the bow is ultimately translated to the hand holding the bow, leading to hand fatigue that can decrease the archer's performance upon the next draw.

Prior art addresses this problem in a variety of ways. One mature concept employs hard stops, typically of varying rubber-like elastomeric material. The prior art devices are positioned on the bow at approximately the neutral bowstring position. Once released, the bowstring travels in the forward direction only so far as the neutral position before striking the hard stop. Such a device truncates the power stroke of the bowstring, translates a large spike of kinetic energy into the bow riser, and merely replaces the audible 'twang' with a muted, but also audible, 'thud'.

Other prior art includes small devices called string silencers of varying geometries that are attached directly to the bowstring. These silencers attempt to dissipate a vibrating bowstring's energy by moving flexible appendages or viscoelastic material. However, they are always attached to the bowstring, and they affect the bowstring performance even during the draw and power stroke.

What is needed is a device that does not affect a bowstring performance from draw through power stroke yet quickly and silently decelerates the bowstring following the power stroke without translating any vibrational energy to the bow or user's bow hand.

SUMMARY OF THE INVENTION

The present invention is a system that prevents the transfer of vibration from a bowstring to a bow riser and simultaneously silences the bowstring from making audible noise. The invention mounts to the riser of a bow or crossbow and disposes at least one rigid finger and integral brush combination adjacent to the bowstring when the bowstring is in the neutral at-rest position. Upon release, the bowstring travels along a path parallel to the rigid finger and through the brush bristles. Kinetic energy of the bowstring is transferred to the brush bristles without inducing any vibration in the bow riser, and the bowstring quickly returns to the at-rest position without audible vibration.

DETAILED DESCRIPTION OF THE INVENTION

Figure 1:
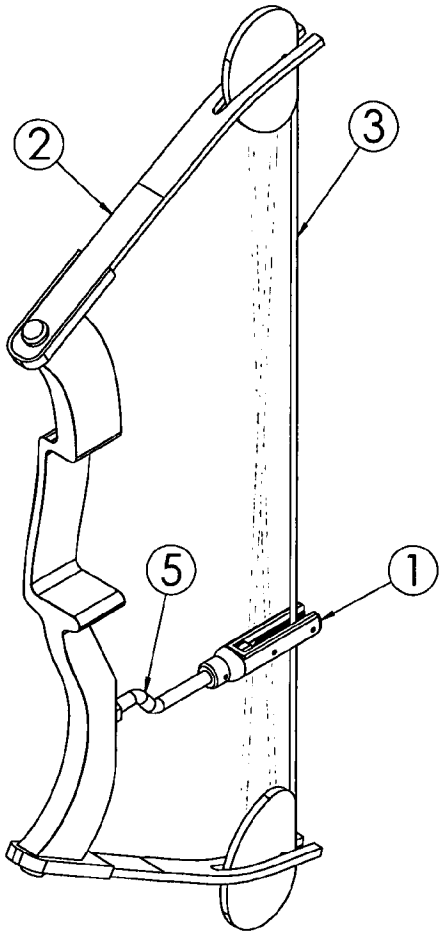
FIG. 1 is an oblique view of a compound bow outfitted with a first embodiment of the present invention.
Figure 2:
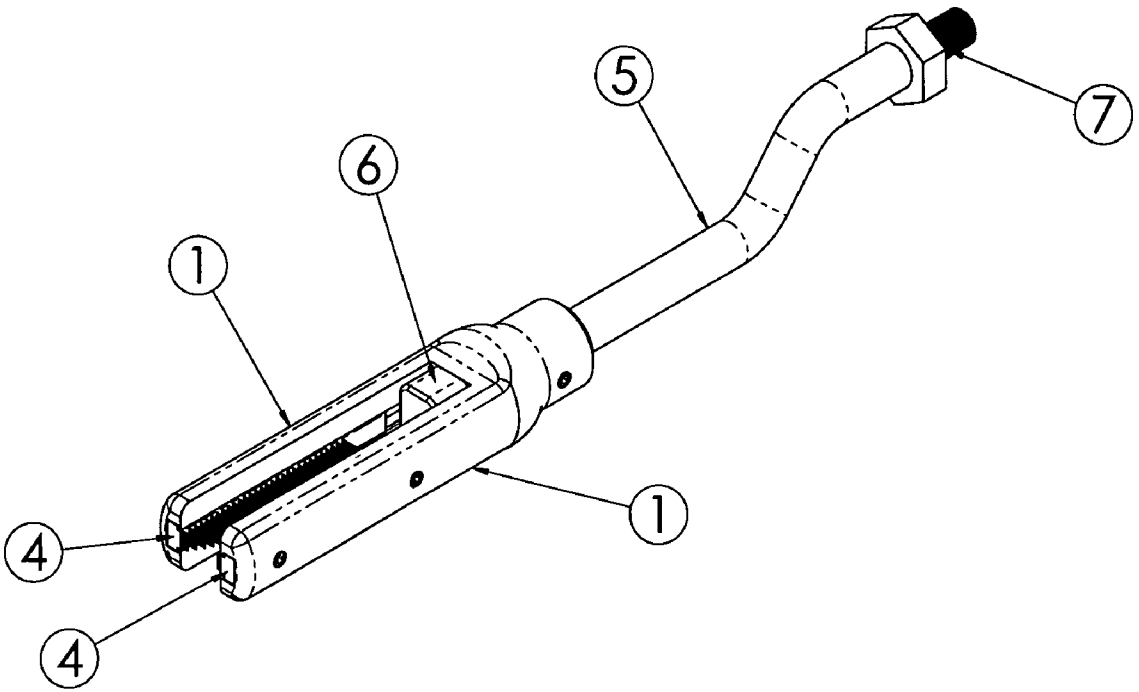
FIG. 2 is a detailed view of a first embodiment of the present invention.

The present invention is a system that prevents the transfer of vibration from a bowstring to a bow riser or crossbow stock and, by eliminating bowstring vibration, also silences the bowstring from making audible noise upon release. With reference to FIGS. 1, 2, 2A, 2B, and 2C, a first embodiment of the invention includes a support arm 5. At a first end, support arm 5 terminates at a mounting means 7 that can attach the invention to the riser of compound bow 2. In the preferred embodiment, mounting means 7 is a threaded post typical in the art for attaching accessories to a bow. Support arm 5 may or may not include a threaded locking nut. Support arm 5 may be straight or include a gentle s-shaped curve as shown in FIG. 2. Mounting means 7 is not limited to a threaded post. One of ordinary skill in the art would understand that other equivalent means can be used to mount the invention to a bow riser or subsequent portion or appendage of an archery bow or crossbow.

At a second end, support arm 5 terminates in at least one rigid finger 1. Each finger 1 further comprises a brush 4 attached to finger 1. Brush 4 is oriented on the side of finger 1 that is adjacent to bowstring 3 and includes a plurality of flexible bristles. The bristles of brush 4 must be at least long enough to make contact with bowstring 3 as it moves in a line parallel to finger 1.

Figure 2C:
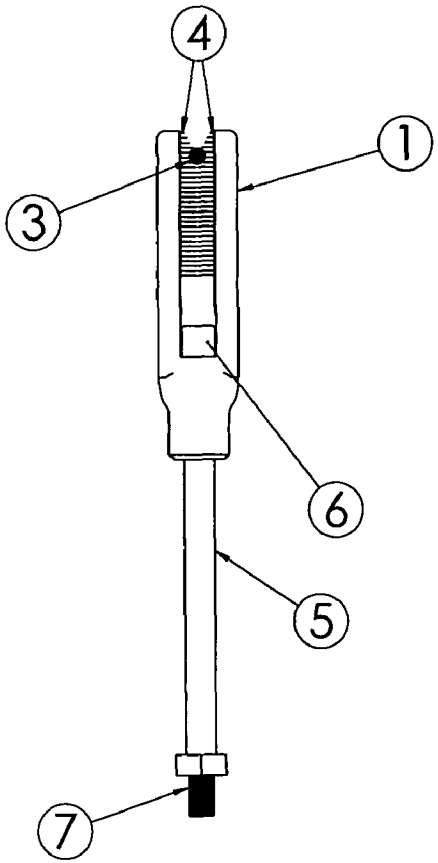
FIG. 2C is an overhead view of the present invention wherein the bowstring is in the maximum rearward position as it vibrates to rest following release.
Figure 2B:
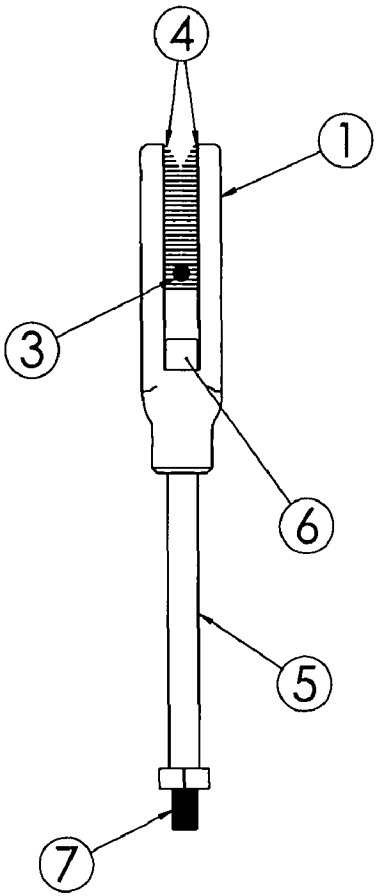
FIG. 2B is an overhead view of the present invention wherein the bowstring is in the maximum forward position at the end of the power stroke following release.
Figure 2A:
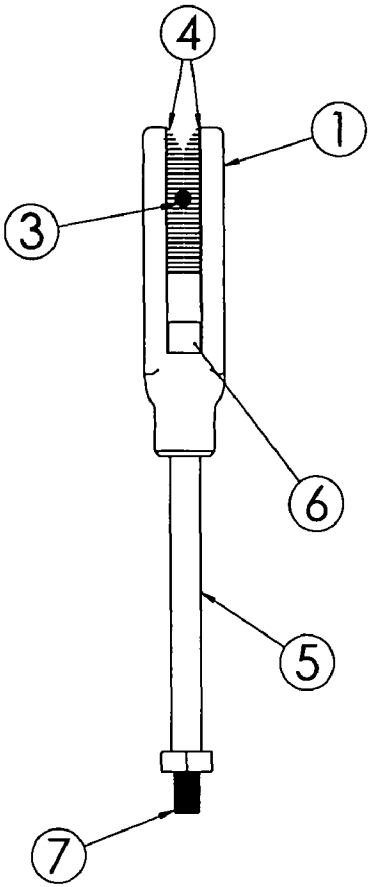
FIG. 2A is an overhead view of the present invention wherein the bowstring is in the neutral, at-rest position.
Figure 4:
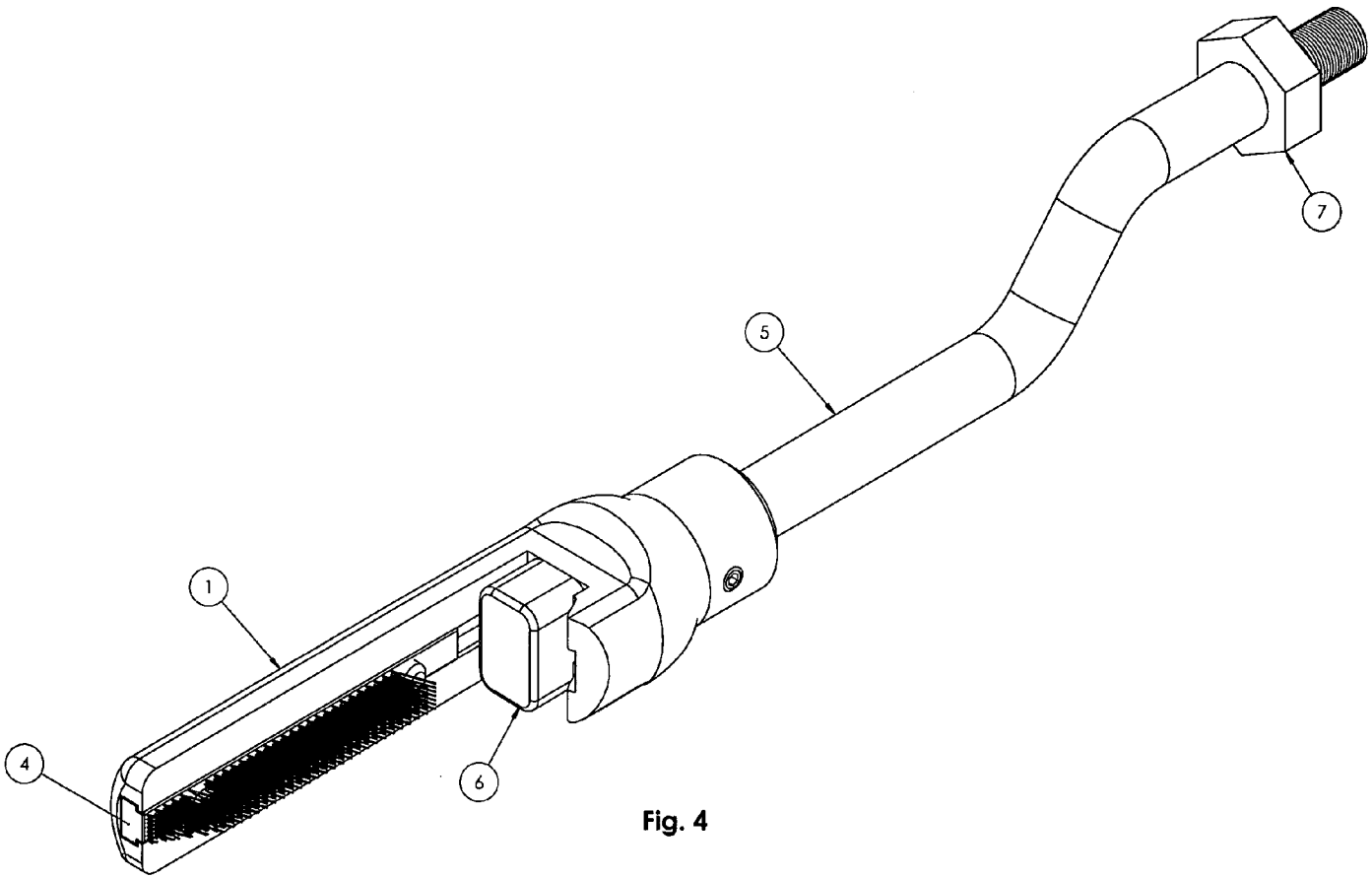
FIG. 4 is a detailed view of a third embodiment of the present invention.

In the preferred embodiment, the second end of support arm 5 includes two fingers 1 arranged in such a geometry that there is one finger 1 disposed on opposing sides of bowstring 3 when bowstring 3 is at rest. As shown in FIGS. 2A, 2B, and 2C, the flexible bristles of brushes 4 are long enough to make contact with bowstring 3 at any point along the length of brushes 4. The bristles of a first brush 4 may be just long enough to make contact with, may overlap, or may make no contact with the bristles of a second, opposing brush 4 so long as contact with bowstring 3 is maintained by all brushes 4. In a second embodiment of the invention, only a single finger 1 is disposed on the side of bowstring 3 as shown in FIG. 4.

Figure 5A:
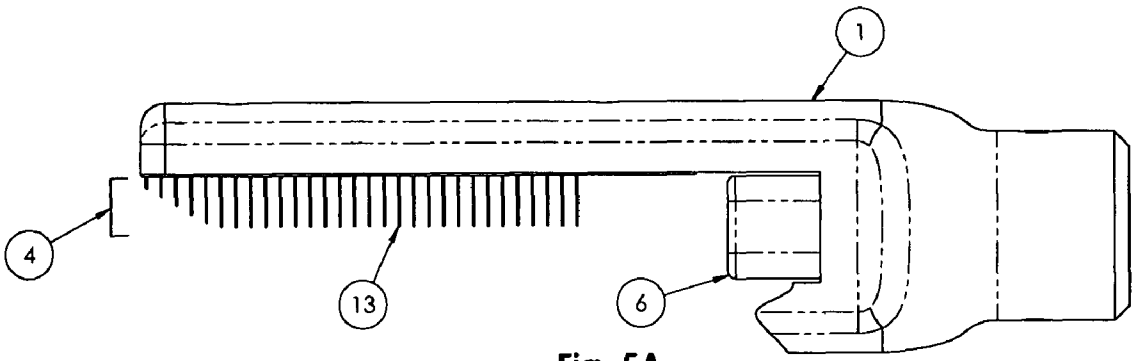
FIG. 5A is a detailed view of the present invention showing a first bristle embodiment.
Figure 5B:
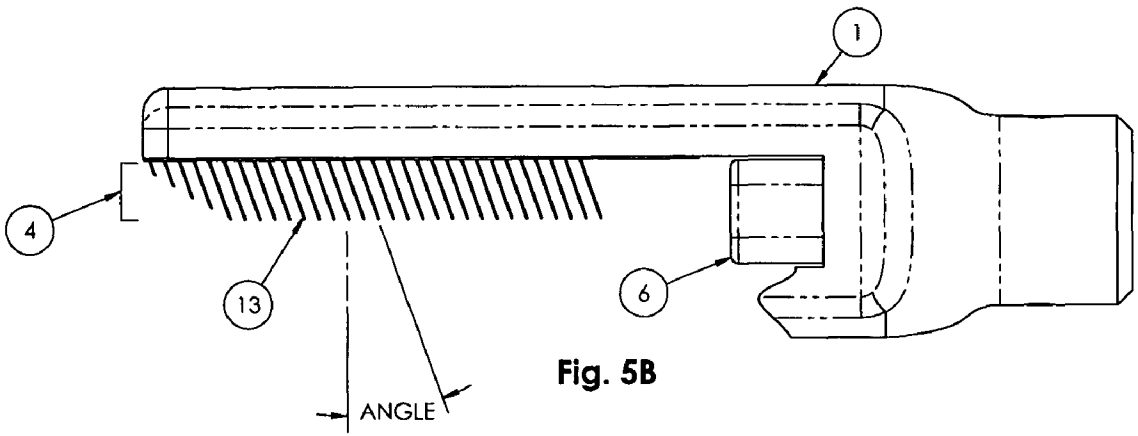
FIG. 5B is a detailed view of the present invention showing a second bristle embodiment.

The brushes 4 are a key feature of the present invention. The bristles of brush 4 are preferentially oriented either perpendicular to the surface of finger 1, as shown in FIG. 5A, or angled forwards towards mounting means 7 at an angle in the range of about five degrees and about forty-five degrees relative to the perpendicular direction, as shown in FIG. 5B. The bristles are fabricated from stiff or flexible material such as, but not limited to, natural hair, polymers, or elastomers.

In operation, the invention quickly brings released bowstring 3 to rest at a neutral position. The invention is attached to the riser of bow 2 and adjusted forward or backward using set screws so that the neutral position of bowstring 3 is approximately half way along the length of brushes 4 as shown in FIG. 2A. Upon draw and release, bowstring 3 travels forward along a line parallel to fingers 1. At the end of forward motion, i.e., the maximum power stroke, bowstring 3 has moved through brushes 4 to the position shown in FIG. 2B yet makes no hard contact with any portion of the invention except for the flexible brushes 4. Bowstring 3 then oscillates in the reverse direction, again moving through brushes 4, to the position shown in FIG. 2C. Bowstring 3 completes no more than a few oscillation cycles before coming to rest. During these minimal oscillations, kinetic energy of bowstring 3 is transferred to bristles 13 of brushes 4 without inducing any vibration or noise in the bow riser. Bowstring 3 has low mass and therefore low inertial moment. A free bowstring may vibrate for several seconds if not damped, while a bowstring used with the present invention is brought to rest almost immediately after release.

A traditional elastomeric stop 6 is positioned ahead of brushes 4 in the event that the device has not been properly installed and the neutral position of bowstring 3 is too far forward. If the present invention is set to the appropriate position, bowstring 3 should never make contact with stop 6. Elastomeric stop 6 prevents unintentional damage to bowstring 3 due to this potential improper installation of the invention.

Figure 3:
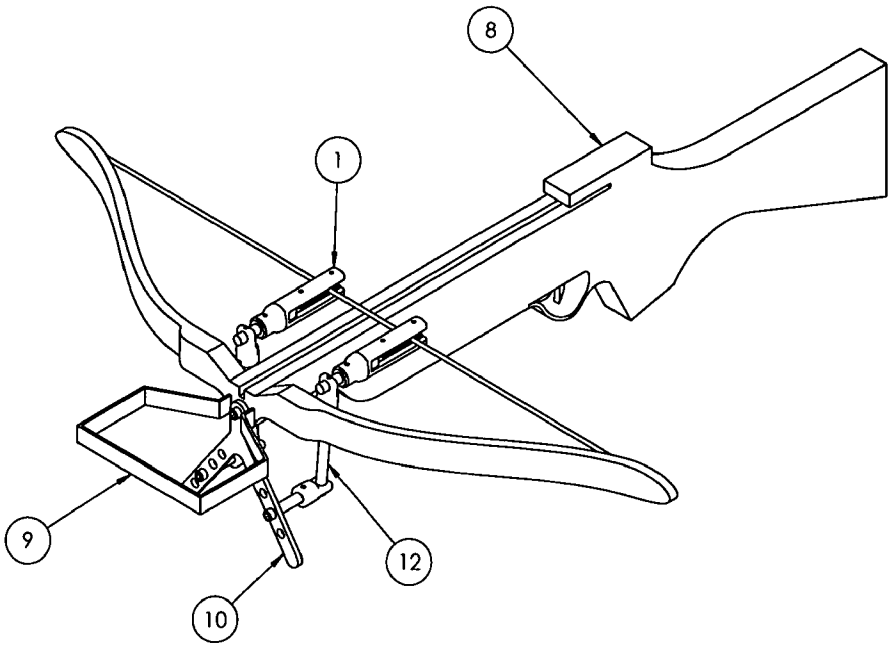
FIG. 3 is an oblique view of a crossbow outfitted with a second embodiment of the present invention.
Figure 3A:
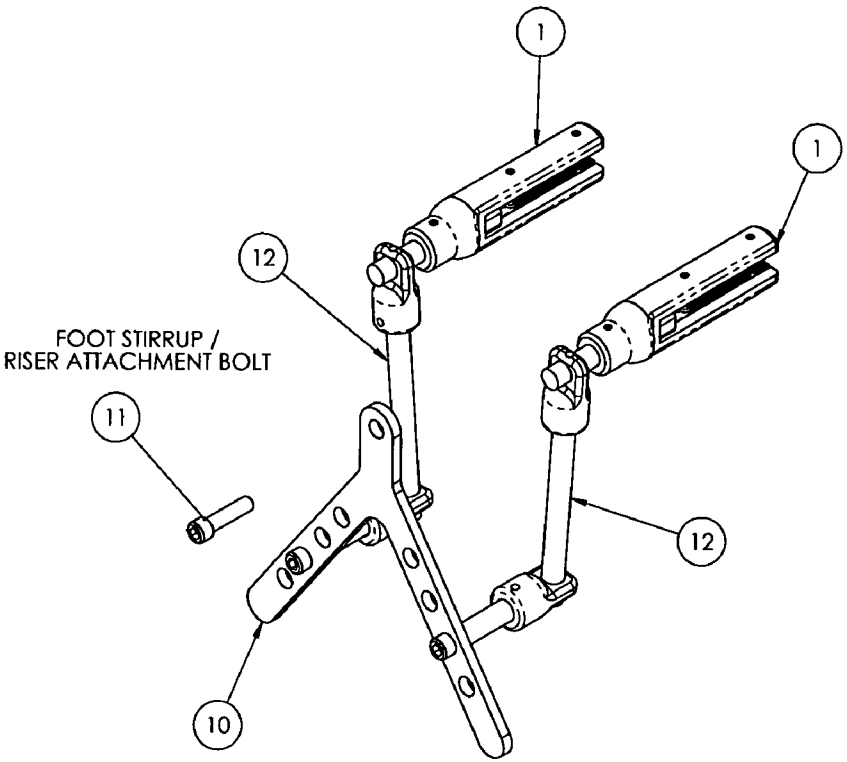
FIG. 3A is a detailed view of a second embodiment of the present invention.

In a third embodiment, the present invention can be mounted to a crossbow as shown in FIGS. 3 and 3A. At least one articulated support arm 12 terminates at a first end by bracket 10 that can, in turn, attach the invention to the foot stirrup or riser of crossbow 8. In the preferred embodiment, bracket 10 is connected to crossbow 8 using attachment bolt 11 as is typical in the art for attaching accessories to the forward end of a crossbow. Bracket 10 may include a plurality of attachment points, and one of ordinary skill in the art would understand that other equivalent means can be used to mount the invention to a crossbow riser.

As shown in FIG. 3, the third embodiment preferentially includes two articulated support arms 12 that each terminate at a second end in at least one rigid finger 1. The two support arms 12 and their associated fingers 1 are positioned symmetrically to the left and right of the crossbow projectile path on the crossbow string. The form and function of rigid fingers 1 and their associated brushes 4 is identical to the description provided for the first, preferred embodiment.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A bowstring vibration and noise eliminator comprising:

a support arm having a first end and a second end, at least one rigid finger, and a mounting end;

wherein said mounting end is integral to the first end of said support arm;

wherein each said finger is integral to the second end of said support arm;

wherein said mounting end attaches the support arm to a bow;

wherein each said finger further comprises a brush attached to said finger;

wherein said brush is oriented on the side of said finger that is adjacent to the bowstring;

wherein said brush includes a plurality of flexible bristles; and wherein the bristles of said brush must be at least long enough to make contact with a released bowstring as said bowstring moves along a line parallel to each said finger.

2. A bowstring vibration and noise eliminator according to claim 1, wherein the second end of said support arm includes two said fingers arranged in such a geometry that there is one finger disposed on each opposing side of the bowstring when the bowstring is at rest; and wherein the bristles of one of the finger's brush are just long enough to make contact with, or overlap, or make no contact with, the bristles an opposing finger's brush, provided contact with the bowstring is maintained by both brushes.

3. A bowstring vibration and noise eliminator according to claim 1, wherein the brush bristles attached to each said finger are substantially oriented perpendicular to the surface of the attached finger.

4. A bowstring vibration and noise eliminator according to claim 1, wherein the brush bristles attached to each said finger are substantially angled forward towards said mounting means at an angle in the range of about five degrees and about forty-five degrees relative to a line that is perpendicular to the surface of the attached finger.

5. A crossbow string vibration and noise eliminator comprising:

at least one articulated support arm, at least one rigid finger attached to each support arm, and a mounting bracket;

wherein each support arm has a first end and a second end;

wherein said mounting bracket is integral to the first end of each support arm;

wherein each said finger is integral to the second end of each support arm;

wherein said mounting bracket attaches each support arm to the stock or riser of a crossbow;

wherein each said finger further comprises a brush attached to said finger;

wherein said brush is oriented on the side of said finger that is adjacent to the crossbow string;

wherein said brush includes a plurality of flexible bristles; and wherein the bristles of said brush must be at least long enough to make contact with a released crossbow string as said crossbow string moves along a line parallel to each said finger.

6. A crossbow string vibration and noise eliminator according to claim 5, wherein the second end of each support arm includes two said fingers arranged in such a geometry that there is one finger disposed on each opposing side of the crossbow string when the crossbow string is at rest; and wherein the bristles of one the finger's brush is just long enough to make contact with, or overlaps, or makes no contact with, the bristles of the opposing finger's brush, provided contact with the crossbow string is maintained by both brushes.

7. A crossbow string vibration and noise eliminator according to claim 5, wherein the brush bristles attached to each said finger are substantially oriented perpendicular to the surface of the attached finger.

8. A crossbow string vibration and noise eliminator according to claim 5, wherein the brush bristles attached to each said finger are substantially angled forward towards said mounting means at an angle in the range of about five degrees and about forty-five degrees relative to a line that is perpendicular to the surface of the attached finger.

9. A crossbow string vibration and noise eliminator according to claim 5, further comprising two said articulated support arms that each terminate at said second end in at least one rigid finger;

wherein said support arms and their associated fingers are positioned symmetrically to left and right sides of the crossbow projectile path on the crossbow string.

10. A crossbow string vibration and noise eliminating system comprising:

a crossbow, and a crossbow string vibration eliminator;

wherein said crossbow includes a crossbow string;

wherein said vibration eliminator further comprises:

at least one support arm, at least one rigid finger attached to each support arm, and a mounting bracket;

wherein each support arm has a first end and a second end;

wherein said mounting bracket is integral to the first end of each support arm;

wherein each said finger is integral to the second end of each support arm;

wherein said mounting bracket attaches each support arm to the stock or riser of a crossbow;

wherein each said finger further comprises a brush attached to said finger;

wherein said brush is oriented on the side of said finger that is adjacent to the crossbow string;

wherein said brush includes a plurality of flexible bristles; and wherein the bristles of said brush must be at least long enough to make contact with a released crossbow string as said crossbow string moves along a line parallel to each said finger;

wherein said crossbow string vibration eliminator is attached to the stock or riser of said crossbow;

wherein said crossbow string vibration eliminator is adjustable forward or backward so that the neutral position of said crossbow string is approximately half way along the length of said brushes;

wherein upon draw and release, said crossbow string travels forward in a line parallel to said fingers; and wherein at the end of forward motion, the released crossbow string has moved through said brushes yet makes no hard contact with any portion of the system except for said flexible brushes.

11. A vibration and noise eliminator for a bow or a crossbow, comprising:

a support arm having a first end and a second end, a non-articulating rigid finger with a planar contact surface, and a mounting end;

wherein said mounting end is integral to the first end of said support arm;

wherein each said finger is integral to the second end of said support arm;

wherein said mounting end is adapted to attach the support arm to a stock or riser of a bow or crossbow;

wherein said planar contact surface is oriented on the side of said finger that is adjacent to a bowstring or a crossbow string;

wherein the planar contact surface of the finger has a longitudinal friction surface that makes rubbing contact with a released bowstring or crossbow string as said released bowstring or crossbow string moves along a line parallel to said finger and transfers kinetic energy to the contact surface of the finger.

12. A vibration and noise eliminator according to claim 11, wherein the second end of said support arm includes two said fingers arranged in such a geometry that there is one finger disposed on each opposing side of the bowstring or crossbow string when the bowstring or crossbow string is at rest; and wherein the planar contact surface of one finger makes contact with, or overlaps, or makes no contact with a planar contact surface of an opposing finger, provided contact with the bowstring or crossbow string is maintained by both planar contact surfaces.

* * * * *